US011168929B2

(12) United States Patent
Lin et al.

(10) Patent No.: US 11,168,929 B2
(45) Date of Patent: Nov. 9, 2021

(54) FLUID TREATMENT DEVICE AND TEMPERATURE REGULATION APPARATUS

(71) Applicant: Midea Group Co., Ltd., Foshan (CN)

(72) Inventors: Chen Lin, Foshan (CN); Bao Yue, Foshan (CN); Hiroshi Omori, Foshan (CN); Jianhui Deng, Foshan (CN)

(73) Assignee: MIDEA GROUP CO., LTD., Foshan (CN)

( * ) Notice: Subject to any disclaimer, the term of this patent is extended or adjusted under 35 U.S.C. 154(b) by 7 days.

(21) Appl. No.: 16/783,093

(22) Filed: Feb. 5, 2020

(65) Prior Publication Data

US 2020/0173701 A1 Jun. 4, 2020

Related U.S. Application Data

(63) Continuation of application No. PCT/CN2018/097258, filed on Jul. 26, 2018.

(30) Foreign Application Priority Data

Aug. 18, 2017 (CN) ..... 201710712165.5

(51) Int. Cl.
*F25B 41/00* (2021.01)
*F25B 1/00* (2006.01)
(Continued)

(52) U.S. Cl.
CPC ..... *F25B 41/00* (2013.01); *F25B 1/00* (2013.01); *F25B 40/02* (2013.01); *F25B 41/30* (2021.01);
(Continued)

(58) Field of Classification Search
CPC .. F25B 41/00; F25B 41/30; F25B 1/00; F25B 40/02; F25B 43/00; F25B 2341/0013; F25B 2341/0012; F25B 2400/23
See application file for complete search history.

(56) References Cited

U.S. PATENT DOCUMENTS 1,958,087 A 4/1930 Hoffman
6,695,686 B1 * 2/2004 Frohlich ..... B24C 1/003 239/433
(Continued)

FOREIGN PATENT DOCUMENTS

CN 101017036 A 8/2007
CN 201819486 U 5/2011
(Continued)

OTHER PUBLICATIONS

CN 106918169A translation.*
(Continued)

*Primary Examiner* — Elizabeth J Martin
(74) *Attorney, Agent, or Firm* — Morgan, Lewis & Bockius LLP

(57) ABSTRACT

A fluid treatment device includes a throttling part; a three-way pipe detachably connected to the throttling part; a drainage part detachably connected to the three-way pipe, with one end of the drainage part being provided with an expansion portion, and the throttling part and the drainage part being coaxial; and a separation part, the expansion portion extending into a space enclosed by side walls of the separation part, a fluid flowing in from a first fluid inlet and a fluid flowing in from a second fluid inlet flowing into the separation part through the expansion portion, and the separation part separating the fluids into a gas phase fluid and a liquid phase fluid. The fluid treatment device integrates the throttling part, the three-way pipe, the drainage part and the separation part.

10 Claims, 6 Drawing Sheets

(51) Int. Cl.
*F25B 40/02* (2006.01)
*F25B 43/00* (2006.01)
*F25B 41/30* (2021.01)

(52) U.S. Cl.
CPC ..... *F25B 43/00* (2013.01); *F25B 2341/0012* (2013.01); *F25B 2341/0013* (2013.01); *F25B 2400/23* (2013.01)

(56) References Cited

U.S. PATENT DOCUMENTS

| | | | | |
|---|---|---|---|---|
| 2010/0313582 | A1* | 12/2010 | Oh | F25B 41/00 62/115 |
| 2011/0056379 | A1 | 3/2011 | Lucas | |
| 2013/0239600 | A1 | 9/2013 | Verma et al. | |

FOREIGN PATENT DOCUMENTS

| | | | | |
|---|---|---|---|---|
| CN | 202289568 | U | | 7/2012 |
| CN | 102872657 | A | | 1/2013 |
| CN | 102878620 | A | | 1/2013 |
| CN | 204665742 | U | | 9/2015 |
| CN | 206247719 | U | | 6/2017 |
| CN | 106918169 | A | * | 7/2017 |
| JP | 05149652 | A | | 6/1993 |
| JP | 1994004556 | U | | 1/1994 |
| JP | 1995260292 | A | | 10/1995 |
| JP | 1995310958 | A | | 11/1995 |
| JP | 2004097995 | A | | 4/2004 |
| JP | 2004101141 | A | | 4/2004 |
| JP | 2004353935 | A | | 12/2004 |
| JP | 2012241963 | A | | 12/2012 |

OTHER PUBLICATIONS

International Search Report, PCT/CN2018/097258, dated Oct. 10, 2018, 2 pgs.
Midea Group Co. Ltd., IPC Search Report, CN201710712165.5, dated Aug. 18, 2017, 4 pgs.
Midea Group Co. Ltd., Notification First Office Action, CN201710712165.5, dated Sep. 17, 2019, 16 pgs.
Midea Group Co. Ltd., Notification of 2nd Office Action, CN201710712165.5, dated Feb. 21, 2020, 12 pgs.
Midea Group Co. Ltd., Notice of Reasons for Refusal, Office Action, Japanese Patent Application No. 2020-501136, dated Feb. 16, 2021, 13 pgs.
Notice of Reasons for Refusal, Japanese Patent Application No. 2020-501136, dated May 26, 2021, 3 pgs.

* cited by examiner

PRIOR ART

FLUID TREATMENT DEVICE AND TEMPERATURE REGULATION APPARATUS

RELATED APPLICATIONS

This application is a continuation of PCT International Application No. PCT/CN2018/097258, filed Jul. 26, 2018, which claims priority of Chinese Patent Application No. 201710712165.5, filed with the China National Intellectual Property Administration on Aug. 18, 2017, the entire contents of which are herein incorporated by reference.

TECHNICAL FIELD

The present disclosure relates to the technical field of temperature regulation apparatus, and particularly relates to a fluid treatment device and a temperature regulation apparatus.

BACKGROUND

At present, a conventional compression-type refrigerating system is as shown in FIG. 1, comprising the main devices and parts such as a compressor 40, a condenser 20, a throttling part, an evaporator 30, and a gas-liquid separator 50. As energy shortage is increasingly serious, higher and higher requirements are imposed on the energy efficiency of compression-type refrigeration cycles. The compressor 40 compresses a gas into a high-temperature and high-pressure gas, which is subjected to the condenser 20 for condensation and heat release, and then enters an ejector 10, and the fluid discharged from the ejector 10 enters the gas-liquid separator 50, which separates the fluid into a gas phase fluid and a liquid phase fluid, wherein the gas phase fluid enters the compressor 40 for circulation flow, the liquid phase fluid enters the evaporator 30 for evaporation and heat release, and the fluid discharged from the evaporator 30 enters the ejector 10 for circulation flow. By introducing the ejector 10 into the refrigerating system, the ejector 10 converts the pressure energy of the fluid during throttling into kinetic energy, increasing the suction pressure of the compressor 40 so as to reduce the compression ratio, thereby reducing energy consumption of the system. The prior art fails to integrate the processes of throttling, drainage, gas-liquid separation, etc. into a single device, so that operational reliability and structural compactness of the system are not high, and the manufacturing cost of the ejector 10 is high, which seriously affects the practicability of the technology.

SUMMARY

The present disclosure aims to solve at least one of the technical problems existing in the prior art or the related art.

To this end, one object of the present disclosure is to provide a fluid treatment device.

The other object of the present disclosure is to provide a temperature regulation apparatus.

In order to achieve the above objects, a technical solution of the first aspect of the present disclosure provides a fluid treatment device, comprising: a throttling part comprising a first fluid inlet; a three-way pipe detachably connected to the throttling part and comprising a second fluid inlet; a drainage part detachably connected to the three-way pipe, with one end of the drainage part being provided with an expansion portion, and the throttling part and the drainage part being coaxial; and a separation part, the expansion portion extending into a space enclosed by side walls of the separation part, a fluid flowing in from the first fluid inlet and a fluid flowing in from the second fluid inlet flowing into the separation part through the expansion portion, and the separation part separating the fluids into a gas phase fluid and a liquid phase fluid, wherein the range of an included angle between an axis of the drainage part and an axis of the separation part is 35 degrees to 60 degrees.

In this technical solution, the fluid flows into a throttling device through the first fluid inlet, the throttling device further reduces the temperature and pressure of the fluid and increases the flow rate of the fluid. The three-way pipe comprises a second fluid inlet, a fluid flowing in from the second fluid inlet is mixed with a fluid flowing in from the first fluid inlet in the three-way pipe, which further increases the pressure energy of the fluid. The mixed fluid in the three-way pipe flows into the separation part through the expansion portion of the drainage part, and the fluid is ejected from the expansion portion. The expansion portion of the drainage part converts the kinetic energy of the fluid into pressure energy to increase the pressure of the fluid and increase the suction pressure of the compressor so as to reduce the compression ratio, thereby reducing the energy consumption of the system. The expansion portion extends directly into the interior of the separation part without passing through other parts such as a draft tube, so that the loss of pressure energy of the fluid can be reduced. The separation part separates the fluid flowing out of the expansion portion into a gas phase fluid and a liquid phase fluid, and delivers the gas phase fluid and the liquid phase fluid into other corresponding devices. When the throttling part and the drainage part are coaxial and the range of the included angle between the axis of the drainage part and the axis of the separation part is 35 degrees to 60 degrees, the fluid generally moves downward under the action of gravity, the path of the fluid from the first fluid inlet into the separation part is straight, and the flow rate is more stable.

In the above, the throttling part, the three-way pipe, the drainage part and the separation part are all detachably connected therebetween, making it simpler and more convenient to assemble the fluid treatment device. The fluid treatment device integrates the throttling part, the three-way pipe, the drainage part and the separation part, has a high level of integration, and has a simple structure, is easy to manufacture, is lower in cost and can easily be nested in existing refrigerating systems. For other parts of the system than the throttling, drainage and separation parts, the existing conventional fittings can be used, making it more convenient to install the fluid treatment device into the system.

It should be noted that the connection between the throttling part and the three-way pipe, the connection between the drainage part and the three-way pipe, and the connection between the drainage part and the separator are detachable connection, e.g., threaded connection and flanged connection; and may also be fixed connection, e.g., welded connection, to increase the stability of the fluid treatment device. The three-way pipe may have a regular T-shape, or other shapes.

In addition, the fluid treatment device in the above-described technical solution provided by the present disclosure can also have the following additional technical features:

In the above-described technical solution, optionally, the three-way pipe comprises: a first pipe portion, a pipe opening of the first pipe portion being fixedly provided with a positioning end cap, and one end of the throttling part passing through a circular hole provided on the positioning end cap and extending into a space enclosed by side walls of the three-way pipe; and a second pipe portion detachably connected to the drainage part.

In the technical solution, the throttling part extends into the three-way pipe through the positioning end cap of the first pipe portion of the three-way pipe, that is, the throttling part is connected with the three-way pipe through the positioning end cap. The diameter of the circular hole of the positioning end cap is equal to the outer diameter of the throttling part, so that the connection between the throttling part and the positioning end cap is more stable. The second pipe portion is detachably connected to the drainage part, so that the assembly of the three-way pipe and the drainage part is simpler and more convenient.

Optionally, the ratio between the inner diameter of the throttling part and the inner diameter of the first pipe portion is $$\frac{1}{8} \sim \frac{1}{2}.$$

The throttling device is detachably connected, or may also be fixedly connected, to the positioning end cap, and the positioning end cap is detachably connected, or may also be fixedly connected, to the first pipe portion. It should be noted that the second pipe portion may also be fixedly connected, e.g., welded, to the drainage part.

In any of the above-described technical solutions, optionally, the inner diameter of a fluid inflow end of the drainage part gradually contracts to a preset value in a fluid inflow direction.

In the technical solution, the inner diameter of the fluid inflow end of the drainage part gradually contracts to a preset value in the fluid inflow direction, which, on the one hand, can guide the mixed fluid flowing in from the first fluid inlet and the second fluid inlet into the drainage part, and on the other hand, increases the flow rate of the mixed fluid as the inner diameter is decreased, thereby increasing the fluid kinetic energy that will be converted into pressure energy in the expansion portion of the drainage part, thereby reducing the loss of pressure energy.

Optionally, the length of the drainage parting the second pipe portion is $$\frac{1}{3} \sim \frac{1}{2}$$

of the entire length of the drainage part, and the inner diameter contraction rate is $$\frac{1}{3} \sim \frac{2}{3}.$$

In any of the above-described technical solutions, optionally, an end surface of one end of the throttling part located in the three-way pipe is located between the maximum-inner-diameter section and the minimum-inner-diameter section of the fluid inflow end of the drainage part.

In the technical solution, by providing one end surface of the throttling part between the maximum-inner-diameter section and the minimum-inner-diameter section of the fluid inflow end of the drainage part, the fluid flowing out of the throttling part can enter the drainage part by the shortest distance, which reduces the loss of kinetic energy of the fluid, thereby reducing the loss of pressure energy.

In the above-described technical solution, optionally, the inner diameter of the expansion portion gradually increases in a fluid flowing direction, and the inner diameter of an end surface of the expansion portion is 1-2 times the inner diameter of the drainage part located in the three-way pipe.

In the technical solution, the inner diameter of the expansion portion gradually increases in the fluid flowing direction, which can gradually pressurize and decelerate the fluid, and when the inner diameter of an end surface of the expansion portion is 1-2 times the inner diameter of the drainage part located in the three-way pipe, the loss of kinetic energy of the fluid is relatively small, and the conversion rate from kinetic energy to pressure energy is relatively high.

In any of the above-described technical solutions, optionally, the separation part further comprises: a fluid separation chamber; a gas phase outlet portion provided on one side of the fluid separation chamber; and a liquid phase outlet portion provided on the other side of the fluid separation chamber with respect to the gas phase outlet portion.

In the technical solution, gas-liquid separation is carried out by the fluid separation chamber, the gas phase is subjected to air buoyancy and moves upward, the liquid phase is subjected to gravity and moves downward, the gas phase fluid flows out through the gas phase outlet portion, the liquid phase fluid flows out through the liquid phase outlet portion, and the gas phase outlet portion and the liquid phase outlet portion are connected on the two opposite sides of the fluid separation chamber, which conforms to the flow laws of the gas phase fluid and the liquid phase fluid, and reduces energy waste.

In any of the above-described technical solutions, optionally, the liquid phase outlet portion further comprises: a draft tube extending outward from the fluid separation chamber and having an inner diameter gradually reduced in the fluid flowing direction; and an outlet pipe communicating with the draft tube and having an inner diameter equal to the minimum inner diameter of the draft tube.

In the technical solution, the liquid phase fluid may be collected by the draft tube and flow into the outlet pipe, and then flow out of the separation part through the outlet pipe. The inner diameter of the outlet pipe is equal to the inner diameter of the draft tube, so that the fluid flows out of the outlet pipe more smoothly.

In any of the above-described technical solutions, optionally, there is further provided: an expansion chamber, the expansion chamber being provided at the first fluid inlet, and the fluid flowing from the first fluid inlet into the throttling part through the expansion chamber; or the expansion chamber being provided between the first fluid inlet and the first pipe portion, and the fluid flowing in through the first fluid inlet, and flowing out from the throttling part through the expansion chamber; wherein the inner diameter of the expansion chamber is larger than the inner diameter of the throttling part.

In the technical solution, by providing the expansion chamber and making the inner diameter of the expansion chamber larger than the inner diameter of the throttling part, the fluid generates a self-excited jet, which further increases the kinetic energy of the fluid in the throttling part.

In any of the above-described technical solutions, optionally, an outer wall of the fluid treatment device is covered with a thermal insulation material, or the fluid treatment device is made of a thermal insulation material.

In the technical solution, the outer wall of the fluid treatment device is covered with a thermal insulation material, or the fluid treatment device is made of a thermal insulation material, which can reduce the heat loss of the fluid treatment device, thereby reducing energy consumption of the system, and improving the cooling or heating effect of the system.

A technical solution of the second aspect of the present disclosure provides a temperature regulation apparatus, comprising: a compressor compressing a gas flowing in into a high-temperature and high-pressure gas; a condenser communicating with the compressor and releasing heat for and cooling the gas discharged from the compressor; a throttling device communicating with the condenser and cooling and depressurizing the fluid discharged from the condenser; a heat regenerator communicating with the throttling device, and supercooling the liquid phase fluid and superheating the gas phase fluid; any of the fluid treatment devices of the technical solutions of the first aspect described above, communicating with the heat regenerator, the fluid treatment device separating the fluid, flowing out from the heat regenerator, into a gas phase fluid and a liquid phase fluid, the gas phase fluid flowing into the heat regenerator and flowing into the compressor through the throttling device; and an evaporator communicating with the fluid treatment device, the liquid phase fluid discharged from the fluid treatment device flowing into the evaporator, the evaporator vaporizing the liquid phase fluid, and the vaporized fluid entering the fluid treatment device.

By using the fluid treatment device of any of the above-described technical solutions, the technical solution has all the advantageous effects of the above-described fluid treatment device. In addition, the fluid is separated into a gas phase fluid and a liquid phase fluid after entering the fluid treatment device. The gas phase fluid passes through the heat regenerator and the throttling device, and then enters the compressor in the temperature regulation apparatus, the compressor compresses the fluid into a high-temperature and high-pressure gas, the high-temperature and high-pressure gas is condensed and heat-released by the condenser in the temperature regulation apparatus, and flows into the fluid treatment device through the throttling device; the liquid phase fluid is evaporated by the evaporator to become a gas-liquid mixture fluid, which enters, together with the gas-liquid mixture fluid flowing in from the throttling device, the fluid treatment device, and the fluid treatment device separates the mixture fluid into a gas phase fluid and a liquid phase fluid; and in this way, the fluid circulates in the temperature regulation apparatus.

Additional aspects and advantages of the present disclosure will become apparent in the following description, or are understood by the practice of the present disclosure.

Figure 1:
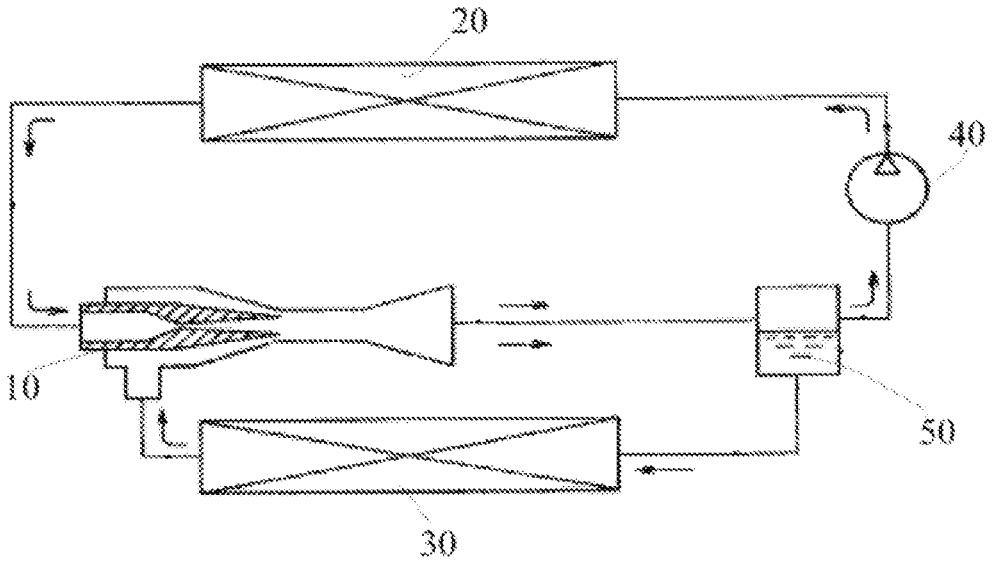
FIG. 1 is a fluid operating diagram of a prior art temperature regulation apparatus.

The corresponding relationship between the reference signs and component names in FIG. 1 is as follows:

10 ejector, 20 condenser, 30 evaporator, 40 compressor, and 50 gas-liquid separator.

The corresponding relationship between the reference signs and component names in FIG. 2 to FIG. 7 is as follows:

1 fluid treatment device, 2 condenser, 3 throttling device, 4 heat regenerator, 5 evaporator, 6 compressor, 7 ejector, 10 throttling part, 20 three-way pipe, 30 drainage part, 102 expansion chamber, 1022 sleeve, 104 first fluid inlet, 202 first pipe portion, 204 second pipe portion, 206 second fluid inlet, 208 positioning end cap, 302 expansion portion, 402 fluid separation chamber, 404 gas phase outlet portion, 406 draft tube, and 408 outlet pipe.

DETAILED DESCRIPTION

In order that the above-mentioned objectives, features and advantages of the present disclosure can be understood more clearly, a further detailed description of the present disclosure will be given below in connection with the accompanying drawings and specific embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure can also be implemented in other manners than those described herein. Therefore, the protection scope of the present disclosure is not limited to the specific embodiments disclosed below.

A fluid treatment device and a temperature regulation apparatus according to the embodiments of the present disclosure are described in detail below with reference to FIG. 2 to FIG. 7.

Figure 2:
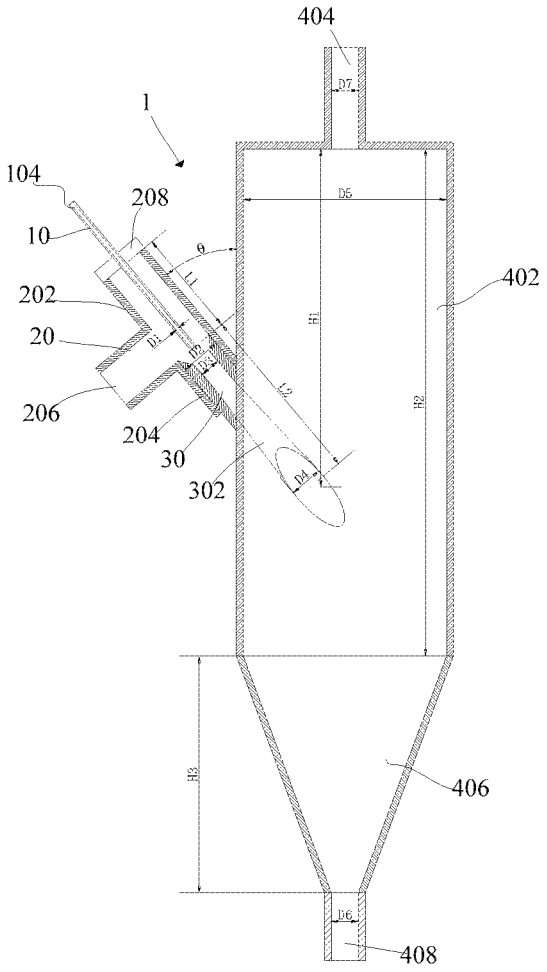
FIG. 2 is a sectional view of a fluid treatment device according to some embodiments.
Figure 3:
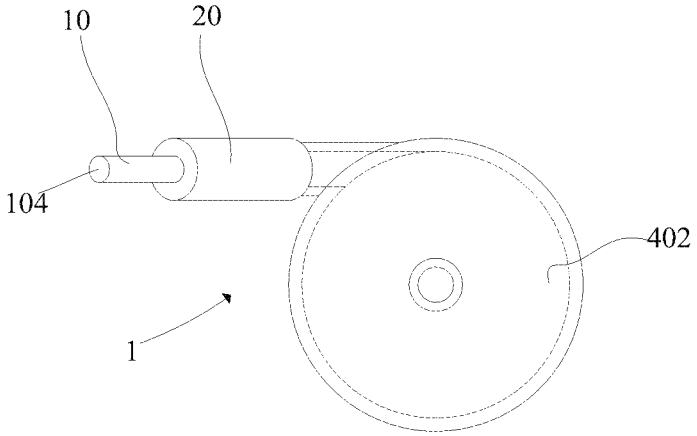
FIG. 3 is a schematic top view of the fluid treatment device according to some embodiments.

As shown in FIG. 2 and FIG. 3, the fluid treatment device 1 according to one embodiment of the present disclosure comprises: a throttling part 10 comprising a first fluid inlet 104; a three-way pipe 20 detachably connected to the throttling part 10 and comprising a second fluid inlet 206; a drainage part 30 detachably connected to the three-way pipe 20, with one end of the drainage part 30 being provided with an expansion portion 302, and the throttling part 10 and the drainage part 30 being coaxial; and a separation part, the expansion portion 302 extending into a space enclosed by side walls of the separation part, a fluid flowing in from the first fluid inlet 104 and a fluid flowing in from the second fluid inlet 206 flowing into the separation part through the expansion portion 302, and the separation part separating the fluids into a gas phase fluid and a liquid phase fluid, wherein the range of an included angle between an axis of the drainage part 30 and an axis of the separation part is 35 degrees to 60 degrees.

In the embodiment, the fluid flows into a throttling device 3 through the first fluid inlet 104, the throttling device 3 further reduces the temperature and pressure of the fluid and increases the flow rate of the fluid. The three-way pipe 20 comprises the second fluid inlet 206, a fluid flowing in from the second fluid inlet 206 is mixed with a fluid flowing in from the first fluid inlet 104 in the three-way pipe 20, which further increases the pressure energy of the fluid. The mixed fluid in the three-way pipe 20 flows into the separation part through the expansion portion 302 of the drainage part, and the fluid is ejected from the expansion portion 302. The expansion portion 302 of the drainage part converts the kinetic energy of the fluid into pressure energy to increase the pressure of the fluid and increase the suction pressure of the compressor 6 so as to reduce the compression ratio, thereby reducing the energy consumption of the system. The expansion portion 302 extends directly into the interior of the separation part without passing through other parts such as a draft tube, so that the loss of pressure energy of the fluid can be reduced. The separation part separates the fluid flowing out of the expansion portion 302 into a gas phase fluid and a liquid phase fluid, and delivers the gas phase fluid and the liquid phase fluid into other corresponding devices. When the throttling part 10 and the drainage part 30 are coaxial and the range of the included angle θ between the axis of the drainage part 30 and the axis of the separation part is 35 degrees to 60 degrees, the fluid generally moves downward under the action of gravity, the path of the fluid from the first fluid inlet 104 into the separation part is straight, and the flow rate is more stable.

In the above, the throttling part 10, the three-way pipe 20, the drainage part 30 and the separation part are all detachably connected therebetween, making it simpler and more convenient to assemble the fluid treatment device 1. The fluid treatment device 1 integrates the throttling part 10, the three-way pipe 20, the drainage part 30 and the separation part, has a high level of integration, and has a simple structure, is easy to manufacture, is lower in cost and can easily be nested in existing refrigerating systems. For other parts of the system than the throttling, drainage and separation parts, the existing conventional fittings can be used, making it more convenient to install the fluid treatment device 1 into the system.

Figure 4:
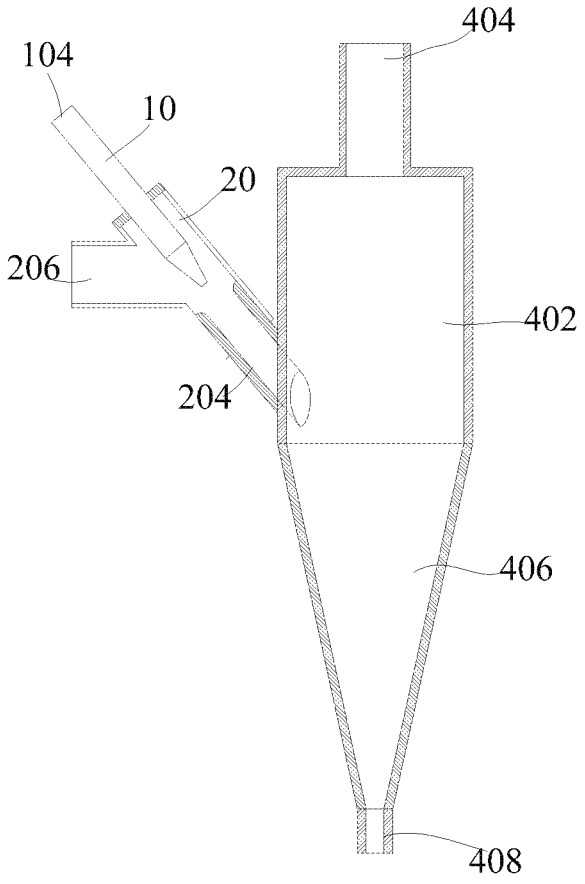
FIG. 4 is a sectional view of the fluid treatment device according to some embodiments.

It should be noted that the connection between the throttling part 10 and the three-way pipe 20, the connection between the drainage part 30 and the three-way pipe 20, and the connection between the drainage part 30 and the separator are detachable connection, e.g., threaded connection and flanged connection; and may also be fixed connection, e.g., welded connection, to increase the stability of the fluid treatment device 1. The three-way pipe 20 may have a regular T-shape, or other shapes (as shown in FIG. 4).

In addition, the fluid treatment device 1 in the above-described embodiment provided by the present disclosure can also have the following additional technical features:

As shown in FIG. 2 and FIG. 3, in the above-described embodiment, optionally, the three-way pipe 20 comprises: a first pipe portion 202, a pipe opening of the first pipe portion 202 being fixedly provided with a positioning end cap 208, and one end of the throttling part 10 passing through a circular hole provided on the positioning end cap 208 and extending into a space enclosed by side walls of the three-way pipe 20; and a second pipe portion 204 detachably connected to the drainage part 30.

In the embodiment, the three-way pipe 20 comprises three pipe openings, i.e., a pipe opening of the first pipe portion 202, a pipe opening of the second pipe portion 204, and the second fluid inlet 206, wherein the throttling part 10 extends into the three-way pipe 20 through the positioning end cap 208 at the pipe opening of the first pipe portion 202, that is, the throttling part 10 is connected with the three-way pipe 20 through the positioning end cap 208.

Optionally, the diameter of the circular hole of the positioning end cap 208 is equal to the outer diameter of the throttling part 10, the inner diameter D1 of the throttling part 10 is 0.2 mm-2.0 mm, and the ratio between the inner diameter D1 of the throttling part 10 and the inner diameter D2 of the first pipe portion 202 is $$\frac{1}{8} \sim \frac{1}{2}.$$

It should be noted that the connection between the positioning end cap 208 and the first pipe portion 202, the connection between the positioning end cap 208 and the throttling part 10, and the connection between the second pipe portion 204 and the drainage part 30 are detachable connection, and may also be fixed connection, e.g., welded connection.

In any of the above-described embodiments, optionally, the inner diameter of a fluid inflow end of the drainage part 30 gradually contracts to a preset value in a fluid inflow direction.

In the embodiment, the inner diameter of the fluid inflow end of the drainage part 30 gradually contracts to a preset value in the fluid inflow direction, which, on the one hand, can guide the mixed fluid flowing in from the first fluid inlet 104 and the second fluid inlet 206 into the drainage part 30, and on the other hand, increases the flow rate of the mixed fluid as the inner diameter is decreased, thereby increasing the fluid kinetic energy that will be converted into pressure energy in the expansion portion 302 of the drainage part 30, thereby reducing the loss of pressure energy.

Optionally, the length of the drainage part 30 in the second pipe portion 204 is $$\frac{1}{3} \sim \frac{1}{2}$$

of the entire length of the drainage part 30, and the inner diameter contraction rate D3:D2 is $$\frac{1}{3} \sim \frac{2}{3}.$$

In any of the above-described embodiments, optionally, an end surface of one end of the throttling part 10 in the three-way pipe 20 is located between the maximum-inner-diameter section and the minimum-inner-diameter section of the fluid inflow end of the drainage part 30.

In the embodiment, by providing one end surface of the throttling part 10 between the maximum-inner-diameter section and the minimum-inner-diameter section of the fluid inflow end of the drainage part 30, the fluid flowing out of the throttling part 10 can enter the drainage part 30 by the shortest distance, which reduces the loss of kinetic energy of the fluid, thereby reducing the loss of pressure energy.

In any of the above-described embodiments, optionally, the inner diameter of the expansion portion 302 gradually increases in a fluid flowing direction, and the inner diameter of an end surface of the expansion portion 302 is 1-2 times the inner diameter of the drainage part located in the three-way pipe 20.

In the embodiment, the inner diameter of the expansion portion 302 gradually increases in the fluid flowing direction, which can gradually pressurize and decelerate the fluid, and when the inner diameter D4 of an end surface of the expansion portion 302 is 1-2 times the inner diameter D3 of the drainage part located in the three-way pipe 20, the loss of kinetic energy of the fluid is relatively small, and the conversion rate from kinetic energy to pressure energy is relatively high.

In any of the above-described embodiments, optionally, the separation part further comprises: a fluid separation chamber 402; a gas phase outlet portion 404 provided on one side of the fluid separation chamber 402; and a liquid phase outlet portion provided on the other side of the fluid separation chamber 402 with respect to the gas phase outlet portion 404.

In the embodiment, gas-liquid separation is carried out by the fluid separation chamber 402, the gas phase is subjected to air buoyancy and moves upward, the liquid phase is subjected to gravity and moves downward, the gas phase fluid flows out through the gas phase outlet portion 404, the liquid phase fluid flows out through the liquid phase outlet portion, and the gas phase outlet portion 404 and the liquid phase outlet portion are connected on the two opposite sides of the fluid separation chamber 402, which conforms to the flow laws of the gas phase fluid and the liquid phase fluid, and reduces energy waste.

Optionally, the three-way pipe 20 has a regular T-shape, the inner diameter of the first pipe portion 202 is equal to the inner diameter of the second pipe portion 204, the ratio between the inner diameter D5 of the fluid separation chamber 402 and the inner diameter D2 of the second pipe portion 204 is 3-6, and the ratio between the vertical dimension H1 of the drainage tube extending into the fluid separation chamber 402 and the inner diameter D5 of the fluid separation chamber 402 is 1.5-3. The gas phase outlet portion 404 is fixedly connected, e.g., welded, to the fluid separation chamber 402, and the liquid phase outlet portion is fixedly connected, e.g., welded, to the fluid separation chamber 402.

In any of the above-described embodiments, optionally, the liquid phase outlet portion further comprises: a draft tube 406 extending outward from the fluid separation chamber 402 and having an inner diameter gradually reduced in the fluid flowing direction; and an outlet pipe 408 communicating with the draft tube 406 and having an inner diameter equal to the minimum inner diameter of the draft tube 406.

In the embodiment, the liquid phase fluid may be collected by the draft tube 406 and flow into the outlet pipe 408, and then flow out of the separation part through the outlet pipe 408. The inner diameter of the outlet pipe 408 is equal to the inner diameter of the draft tube 406, so that the fluid flows out of the outlet pipe 408 more smoothly.

Optionally, the ratio between the vertical height H2 of the fluid separation chamber 402 and the vertical height H3 of the draft tube 406 is 1-2.5. The inner diameter D6 of the outlet pipe 408 is equal to the inner diameter D7 of the gas phase outlet portion 404.

Figure 5:
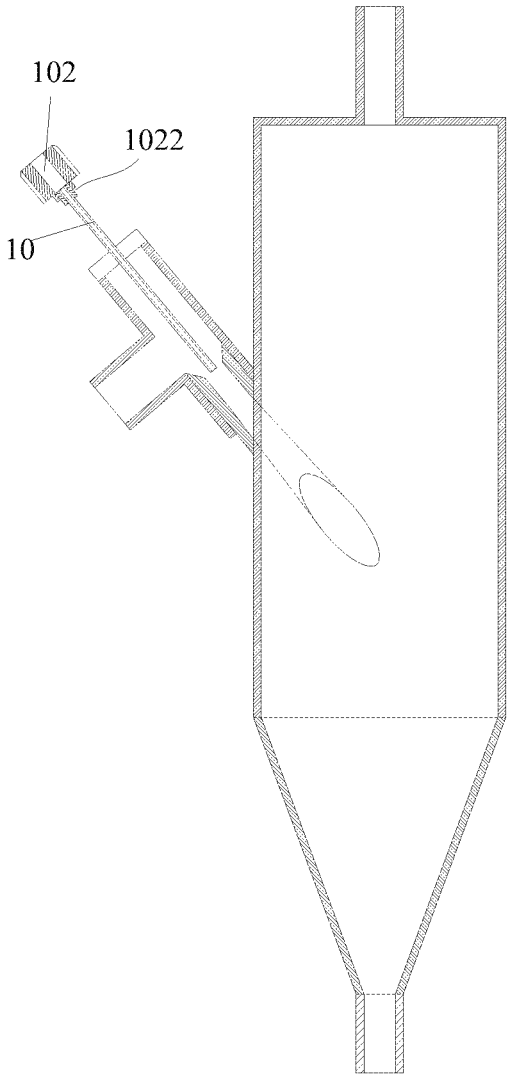
FIG. 5 is a sectional view of the fluid treatment device according to some embodiments.
Figure 6:
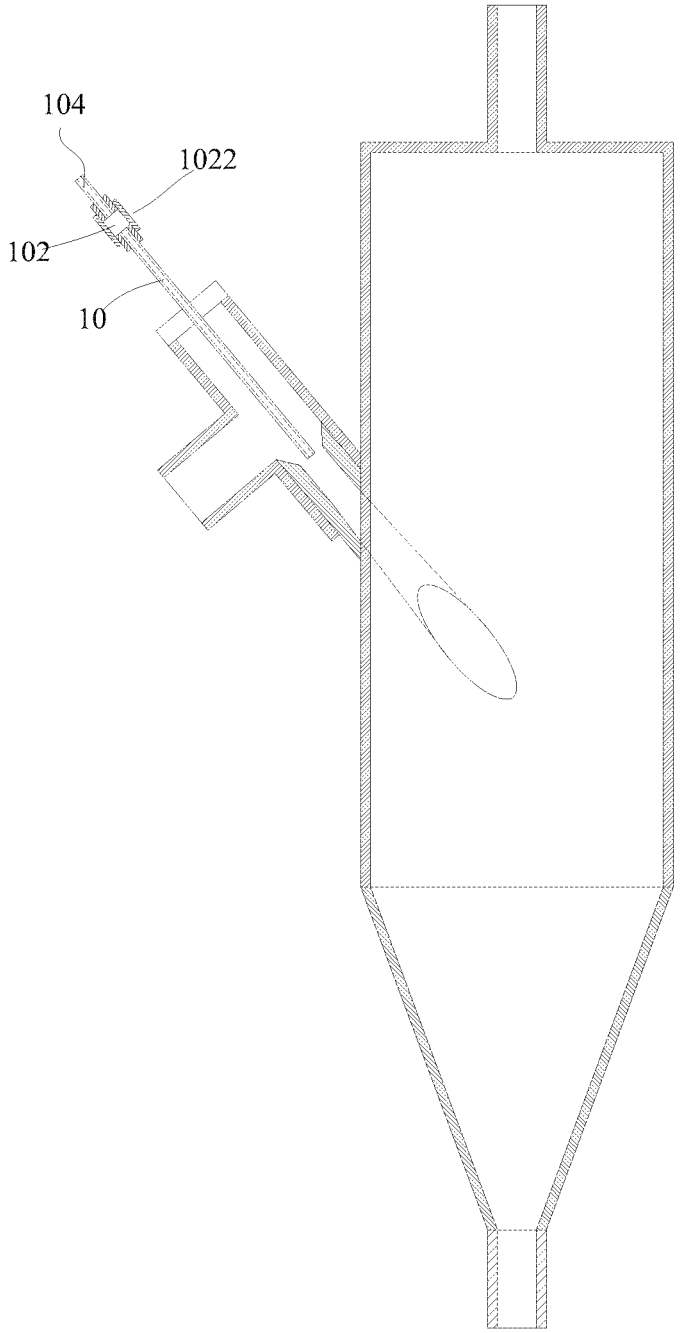
FIG. 6 is a sectional view of the fluid treatment device according to some embodiments.

As shown in FIG. 5 and FIG. 6, in any of the above-described embodiments, optionally, there is further provided: an expansion chamber 102, the expansion chamber 102 being provided at the first fluid inlet 104, and the fluid flowing from the first fluid inlet 104 into the throttling part 10 through the expansion chamber 102; or the expansion chamber 102 being provided between the first fluid inlet 104 and the first pipe portion 202, and the fluid flowing in through the first fluid inlet 104, and flowing out from the throttling part 10 through the expansion chamber 102; wherein the inner diameter of the expansion chamber 102 is larger than the inner diameter of the throttling part 10.

In the embodiment, by providing the expansion chamber 102 and making the inner diameter of the expansion chamber 102 larger than the inner diameter of the throttling part 10, the fluid generates a self-excited jet, which further increases the kinetic energy of the fluid in the throttling part 10.

Optionally, as shown in FIG. 5, when the expansion chamber 102 is provided at the first fluid inlet 104, the expansion chamber 102 is a screwed nipple, the inner cavity of the screwed nipple is a cavity in which the expansion chamber 102 contains fluid, a sleeve 1022 is sleeved outside the throttling part 10, and the expansion chamber 102 is threadedly connected to the sleeve 1022 so as to be connected to the throttling part 10; as shown in FIG. 6, when the expansion chamber 102 is provided between the first fluid inlet 104 and the first pipe portion 202, the exterior of the side wall of the expansion chamber 102 comprises a sleeve 1022 for protecting the expansion chamber 102, and the throttling device 3 is fixedly connected, e.g., welded, to both ends of the expansion chamber 102.

In any of the above-described embodiments, optionally, an outer wall of the fluid treatment device 1 is covered with a thermal insulation material, or the fluid treatment device is made of a thermal insulation material.

In the embodiment, the outer wall of the fluid treatment device 1 is covered with a thermal insulation material, or the fluid treatment device 1 is made of a thermal insulation material, which can reduce the heat loss of the fluid treatment device 1, thereby reducing energy consumption of the system, and improving the cooling or heating effect of the system.

Figure 7:
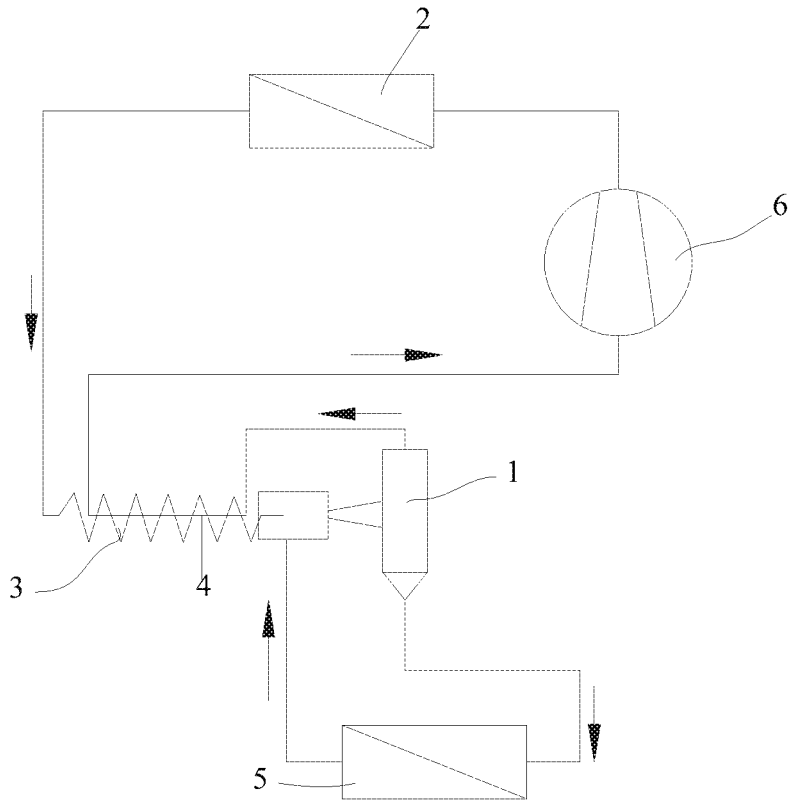
FIG. 7 is a fluid operating diagram of a temperature regulation apparatus according to some embodiments.

FIG. 7 shows a temperature regulation apparatus according to one embodiment of the present disclosure, comprising: a compressor 6 compressing a gas flowing in into a high-temperature and high-pressure gas; a condenser 2 communicating with the compressor 6 and releasing heat for and cooling the gas discharged from the compressor 6; a throttling device 3 communicating with the condenser 2 and cooling and depressurizing the fluid discharged from the condenser 2; a heat regenerator 4 communicating with the throttling device 3, and supercooling the liquid phase fluid and superheating the gas phase fluid; the fluid treatment device 1 communicating with the heat regenerator 4, the fluid treatment device 1 separating the fluid, flowing out from the heat regenerator 4, into a gas phase fluid and a liquid phase fluid, the gas phase fluid flowing into the heat regenerator 4 and flowing into the compressor 6 through the throttling device 3; and an evaporator 5 communicating with the fluid treatment device 1, the liquid phase fluid discharged from the fluid treatment device 1 flowing into the evaporator 5, the evaporator 5 vaporizing the liquid phase fluid, and the vaporized fluid entering the fluid treatment device 1.

By using the fluid treatment device 1 of any of the above-described embodiments, the embodiment has all the advantageous effects of the above-described fluid treatment device 1. Moreover, the fluid is separated into a gas phase fluid and a liquid phase fluid after entering the fluid treatment device 1. The gas phase fluid passes through the heat regenerator 4 and the throttling device 3, and then enters the compressor 6 in the temperature regulation apparatus, the compressor 6 compresses the fluid into a high-temperature and high-pressure gas, the high-temperature and high-pressure gas is condensed and heat-released by the condenser 2 in the temperature regulation apparatus, and flows into the fluid treatment device 1 through the throttling device 3; the liquid phase fluid is evaporated by the evaporator 5 to become a gas-liquid mixture fluid, which enters, together with the gas-liquid mixture fluid flowing in from the throttling device 3, the fluid treatment device 1, and the fluid treatment device 1 separates the mixture fluid into a gas phase fluid and a liquid phase fluid; and in this way, the fluid circulates in the temperature regulation apparatus.

Additional aspects and advantages of the present disclosure will become apparent in the following description, or are understood by the practice of the present disclosure.

As shown in FIG. 2 and FIG. 3, the fluid treatment device 1 comprises a throttling part 10, a three-way pipe 20, a drainage part 30 and a separator, the connection between the throttling part 10 and the three-way pipe 20, the connection between the drainage part 30 and the three-way pipe 20, and the connection of the drainage part 30 and the separator are all detachable connection. θ ranges from 35 degrees to 60 degrees, the inner diameter D1 of the throttling part 10 is 0.2 mm-2.0 mm, the value of D1:D2 is $$\frac{1}{8} \sim \frac{1}{2},$$

the length of the drainage part within the second pipe portion 204 is $$\frac{1}{3} \sim \frac{1}{2}$$

of the entire length of the drainage part 30, the inner diameter contraction rate D3:D2 is $$\frac{1}{3} \sim \frac{2}{3},$$

the value of D4:D3 is 1-2, the value of D5:D2 is 3-6, the value of H1:D5 is 1.5-3, the value of H2:H3 is 1-2.5, and D6 is equal to D7.

As shown in FIG. 4, the three-way pipe in the fluid treatment device 1 does not have a regular T-shape, and the included angle between the second fluid inlet 206 and the first pipe portion 202 of the three-way pipe 20 is less than 90 degrees.

As shown in FIG. 5, the fluid treatment device 1 further comprises an expansion chamber 102 provided at the first fluid inlet 104 and threadedly connected to the throttling part 10.

As shown in FIG. 6, the expansion chamber 102 is provided between the first fluid inlet 104 and the first pipe portion 202, and both ends of the expansion chamber 102 are fixedly connected to the throttling part 10 by welding.

The technical solutions of the present disclosure have been described above in detail with reference to the accompanying drawings. The present disclosure provides a fluid treatment device and a temperature regulation apparatus. The fluid treatment device integrates the throttling part, the three-way pipe, the drainage part and the separation part, has a high level of integration, and has a simple structure, is easy to manufacture, is lower in cost and can easily be nested in existing refrigerating systems. For other parts of the system than the throttling, drainage and separation parts, the existing conventional fittings can be used, making it more convenient to install the fluid treatment device into the system.

In the present disclosure, the terms "first", "second", and "third" are used for the purpose of description only, and cannot be understood as indicating or implying relative importance; the term "a plurality of" means two or more, unless otherwise explicitly defined. The terms "installing", "connected", "connection", "fixing" and the like should be understood in a broad sense. For example, "connection" may be a fixed connection, a removable connection or an integral connection; the term "connected" may refer to being directly connected and may also refer to being indirectly connected through an intermediary. A person of ordinary skills in the art could understand the specific meaning of the terms in the present disclosure according to specific situations.

In the description of the present disclosure, it should be understood that the orientation or position relationships indicated by the terms "upper", "lower", "left", "right", "front", "back" and the like are the orientation or position relationships based on what is shown in the drawings, are merely for the convenience of describing the present disclosure and simplifying the description, and do not indicate or imply that the device or unit referred to must have a particular direction and is constructed and operated in a specific orientation, and thus cannot be understood as the limitation of the present disclosure.

In the description of the present specification, the descriptions of the terms "one embodiment", "some embodiments" and "specific embodiments" and the like mean that specific features, structures, materials or characteristics described in conjunction with the embodiment(s) or example(s) are included in at least one embodiment or example of the present disclosure. In the specification, the schematic representation of the above terms does not necessarily refer to the same embodiment or example. Moreover, the particular features, structures, materials or characteristics described may be combined in a suitable manner in any one or more embodiments or examples.

The descriptions above are only preferred embodiments of the present disclosure, which are not used to limit the present disclosure. For a person skilled in the art, the present disclosure may have various changes and variations. Any modifications, equivalent substitutions, improvements etc. within the spirit and principle of the present disclosure shall all be included in the protection scope of the present disclosure.

What is claimed is:

1. A fluid treatment device, comprising:

a throttling part comprising a first fluid inlet;

a three-way pipe detachably connected to the throttling part and comprising a second fluid inlet;

a drainage part detachably connected to the three-way pipe, with one end of the drainage part being provided with an expansion portion, and the throttling part and the drainage part being coaxial; and a separation part, the expansion portion extending into a space enclosed by side walls of the separation part, a fluid flowing in from the first fluid inlet and a fluid flowing in from the second fluid inlet flowing into the separation part through the expansion portion, and the separation part separating the fluids into a gas phase fluid and a liquid phase fluid, wherein a range of an included angle between an axis of the drainage part and an axis of the separation part is 35 degrees to 60 degrees.

2. The fluid treatment device according to claim 1, wherein the three-way pipe comprises:

a first pipe portion, a pipe opening of the first pipe portion being fixedly provided with a positioning end cap, and one end of the throttling part passing through a circular hole provided on the positioning end cap and extending into a space enclosed by side walls of the three-way pipe; and a second pipe portion detachably connected to the drainage part.

3. The fluid treatment device according to claim 1, wherein the inner diameter of a fluid inflow end of the drainage part gradually contracts to a preset value along a fluid inflow direction.

4. The fluid treatment device according to claim 3, wherein an end surface of one end of the throttling part located in the three-way pipe is located between the maximum-inner-diameter section and the minimum-inner-diameter section of the fluid inflow end of the drainage part.

5. The fluid treatment device according to claim 1, wherein the inner diameter of the expansion portion gradually increases along a fluid flowing direction, and the inner diameter of an end surface of the expansion portion is 1-2 times the inner diameter of the drainage part located in the three-way pipe.

6. The fluid treatment device according to claim 1, wherein the separation part further comprises:

a fluid separation chamber;

a gas phase outlet portion provided on one side of the fluid separation chamber; and a liquid phase outlet portion provided on the other side of the fluid separation chamber with respect to the gas phase outlet portion.

7. The fluid treatment device according to claim 6, wherein the liquid phase outlet portion further comprises:

a draft tube extending outward from the fluid separation chamber and having an inner diameter gradually reduced along the fluid flowing direction; and an outlet pipe communicating with the draft tube and having an inner diameter equal to the minimum inner diameter of the draft tube.

8. The fluid treatment device according to claim 7, further comprising:

an expansion chamber provided at the first fluid inlet, the fluid flowing from the first fluid inlet into the throttling part through the expansion chamber; or the expansion chamber being provided between the first fluid inlet and the first pipe portion, and the fluid flowing in through the first fluid inlet, and flowing out from the throttling part through the expansion chamber, wherein the inner diameter of the expansion chamber is larger than the inner diameter of the throttling part.

9. The fluid treatment device according to claim 1, wherein an outer wall of the fluid treatment device is covered with a thermal insulation material, or the fluid treatment device is made of a thermal insulation material.

10. A temperature regulation apparatus, comprising:

a compressor compressing a gas flowing in into a high-temperature and high-pressure gas;

a condenser communicating with the compressor and releasing heat for and cooling the gas discharged from the compressor;

a throttling device communicating with the condenser and cooling and depressurizing the fluid discharged from the condenser;

a heat regenerator communicating with the throttling device, and supercooling the liquid phase fluid and superheating the gas phase fluid; and a fluid treatment device communicating with the throttling device, the fluid treatment device separating the fluid flowing out from the throttling device into a gas phase fluid and a liquid phase fluid, wherein the gas phase fluid flows into the heat regenerator and flows into the compressor through the throttling device; and an evaporator communicating with the fluid treatment device, the liquid phase fluid discharged from the fluid treatment device flowing into the evaporator, the evaporator vaporizing the liquid phase fluid, and the vaporized fluid entering the fluid treatment device.

* * * * *